US008161712B2

(12) United States Patent
Mackenzie

(10) Patent No.: US 8,161,712 B2
(45) Date of Patent: Apr. 24, 2012

(54) FLEXIBLE WRAP OF ROTATABLY INTERLOCKING FLUTED STRIPS

(76) Inventor: Douglas A. Mackenzie, Marshall, NC (US)

( * ) Notice: Subject to any disclaimer, the term of this patent is extended or adjusted under 35 U.S.C. 154(b) by 226 days.

(21) Appl. No.: 12/725,839

(22) Filed: Mar. 17, 2010

(65) Prior Publication Data

US 2010/0236182 A1 Sep. 23, 2010

Related U.S. Application Data

(60) Provisional application No. 61/202,640, filed on Mar. 19, 2009.

(51) Int. Cl.
*E04H 12/00* (2006.01)

(52) U.S. Cl. ..... 52/844; 52/845; 52/836

(58) Field of Classification Search ..... 52/831–832, 52/834–836, 843–845, 651.01, 723.1, 723.2, 52/731.2, 731.3, 732.1, 732.2, 588.1, 589.1, 52/591.1, 592.1, 592.6, FOR. 109–FOR. 110, 52/FOR. 115–FOR. 116, FOR. 126, FOR. 129–FOR. 130, FOR. 134–FOR. 135, FOR. 142–FOR. 143, 52/FOR. 154–FOR. 155, FOR. 159–FOR. 160; 220/560.12

See application file for complete search history.

(56) References Cited

U.S. PATENT DOCUMENTS

| | | | | | |
|---|---|---|---|---|---|
| 4,606,167 | A | | 8/1986 | Thorne | |
| 4,640,437 | A | * | 2/1987 | Weingartner | 220/560.12 |
| 4,912,901 | A | | 4/1990 | Jerry | |
| 5,266,738 | A | | 11/1993 | MacVoy | |
| 5,311,713 | A | | 5/1994 | Goodrich | |
| 5,335,471 | A | | 8/1994 | Kupiec | |
| 5,956,920 | A | | 9/1999 | Davis | |
| 5,987,845 | A | * | 11/1999 | Laronde | 52/845 |
| 6,094,881 | A | * | 8/2000 | Lockwood | 52/845 |
| 6,167,673 | B1 | | 1/2001 | Fournier | |
| 6,176,062 | B1 | | 1/2001 | Fayle | |
| 6,286,281 | B1 | * | 9/2001 | Johnson | 52/592.1 |
| 6,302,285 | B1 | * | 10/2001 | Fulle | 211/189 |
| 6,305,140 | B1 | | 10/2001 | Knight | |
| 6,357,196 | B1 | * | 3/2002 | McCombs | 52/845 |
| 6,564,960 | B1 | * | 5/2003 | Grindstaff et al. | 220/4.31 |
| 7,168,220 | B2 | | 1/2007 | Owoc et al. | |
| 7,464,512 | B1 | * | 12/2008 | Perina | 52/651.01 |
| 8,074,424 | B2 | * | 12/2011 | Waters et al. | 52/834 |
| 2005/0271467 | A1 | * | 12/2005 | Ong | 403/359.1 |
| 2007/0266670 | A1 | * | 11/2007 | Williams | 52/731.2 |

OTHER PUBLICATIONS

H.E. Williams, Inc., Carthage, MO, *Decorative Tapered and Stepped Aluminum Pole and Base*, Oct. 28, 2008, 2 pgs. Allen Architectural Metals, Inc. vol. 2 *Products Portfolio*, 2006-2007, 20 pgs.

* cited by examiner

*Primary Examiner* — Basil Katcheves
*Assistant Examiner* — Beth Stephan
(74) *Attorney, Agent, or Firm* — Brinks Hofer Gilson & Lione

(57) ABSTRACT

A flexible wrap of rotatably interlocking fluted strips is provided. The fluted strips may have similarly shaped cross-sectional areas and be rotatably interconnected with one another such that the flexible wrap may be wrapped around an object. One end of a fluted strip may have a socket means for rotatably interlocking with an adjacent fluted strip. The socket means may have a circular inner diameter and two curved arms with an opening between their ends. The opposite end of the fluted strip may have a ball means for rotatably interlocking with another adjacent fluted strip. The ball means may have a circular outer diameter sized to slide into the circular inner diameter of the socket means of an adjacent fluted strip, and an arm sized to slide between the opening of the curved arms, during assembly. One fluted strip may be designed to join in the middle to facilitate wrapping.

19 Claims, 15 Drawing Sheets

FLEXIBLE WRAP OF ROTATABLY INTERLOCKING FLUTED STRIPS

RELATED APPLICATIONS

The present Application claims priority to U.S. Provisional Application Ser. No. 61/202,640, filed on Mar. 19, 2009 and entitled Utility Pole to Lamp Post Conversion Kit, the entirety of which is hereby incorporated by reference. The present Application is also related to U.S. Design patent Ser. No. 29/357,801, filed on the same day as the present Application, and which is also incorporated herein by reference in its entirety.

FIELD

The present invention generally relates to column wrap assemblies. More particularly, a multi-piece column wrap assembly for upgrading pillars and other objects is provided.

BACKGROUND

Conventional column wraps may be used to cover a support or structural column of a house. Recent column wraps include the column wrap kits manufactured by AIC Millworks. These column wraps may be manufactured from PVC and include two pieces that snap together. The two pieces may each include two flat sides affixed at a right angle forming a L-shape for a tight fit with a corner of a square pole, such as a porch post.

Other recent column wraps include the single-piece post cladding element of U.S. Pat. No. 7,168,220 ("the '220 patent"). There, the Abstract discloses "a one-piece elongated tubular flexible member body having a continuous seam closure formed along the body."

The '220 patent notes that multi-piece cladding assemblies are known. With respect to U.S. Pat. No. 5,956,920, the Background of the '220 patent states "multiple piece assemblies, however, require significant assemblage efforts and include several connection seams, each of which is subject to failure and provides an entry point for moisture." Therefore, conventional column wraps may include various short-comings, including those noted above.

BRIEF SUMMARY

A flexible wrap of rotatably interlocked fluted strips is provided. Each fluted strip may have a cross-sectional area comprising a socket cross-section and a ball cross-section on opposite ends. The socket cross-section of each fluted strip may be configured to lockingly accept the ball cross-section of an adjacent fluted strip. Further, the socket and ball cross-sections may be sized such that each fluted strip longitudinally rotates with respect to both of the adjacent interlocking fluted strips. After assembly, a set of the rotatably interlocked fluted strips may form a flexible wrap that can be wrapped around an object.

In one embodiment, an interlocking fluted strip for rotatably interlocking with adjacent interlocking fluted strips, each having similarly shaped socket and ball cross-sections, to form a flexible wrap is provided. The interlocking fluted strip may include: a strip having a first end and a second end, the first end being opposite the second side; a socket cross-section located along a first longitudinal length of the first end of the strip, the socket cross-section may have an inner curved surface having a first diameter; and a ball cross-section located along a second longitudinal length of the second end of the strip, the ball cross-section may have an outer curved surface having a second diameter. The second diameter of the outer curved surface of the ball cross-section may be less than or approximately equal to the first diameter of the inner curved surface of the socket cross-section.

As a result, the socket cross-section of the interlocking fluted strip may be configured to rotatably interlock with a second ball cross-section of a second interlocking fluted strip, and the ball cross-section of the interlocking fluted strip may be configured to rotatably interlock with a third socket cross-section of a third interlocking fluted strip. The interlocking fluted strip may be rotatably interlocked with the second interlocking fluted strip along the first longitudinal length of the first end of the strip and also rotatably interlocked with the third interlocking fluted strip along the second longitudinal length of the second end of the strip such that wrapping the resulting flexible wrap around an object is facilitated.

In another embodiment, a flexible wrap of rotatably interlocking fluted strips is provided. The flexible wrap may include a set of interlocking fluted strips, each interlocking fluted strip within the set may have a substantially similar cross-sectional shape. The set of interlocking fluted strips may include a first interlocking fluted strip, a second interlocking fluted strip, and a third interlocking fluted strip. The first interlocking fluted strip may include a socket means for rotatably interconnecting the first interlocking fluted strip with the second interlocking fluted strip along a first longitudinal length of the first interlocking fluted strip such that the first interlocking fluted strip rotates with respect to the second interlocking fluted strip along the first longitudinal length. The first interlocking fluted strip may also include a ball means for rotatably interconnecting the first interlocking fluted strip with the third interlocking fluted strip along a second longitudinal length of the first interlocking fluted strip such that the first interlocking fluted strip rotates with respect to the third interlocking fluted strip along the second longitudinal length. The rotatable interconnections between the first interlocking fluted strip and each of the second interlocking fluted strip and the third interlocking fluted strip, respectively, facilitate wrapping the resulting flexible wrap of rotatably interlocking fluted strips around an object.

In another embodiment, a flexible wrap of rotatably interlocking fluted strips is provided. The flexible wrap may include a set of rotatably interlocking fluted strips having similarly shaped socket and ball cross-sections. The set may include a first fluted strip, a first adjacent fluted strip, and a second adjacent fluted strip. The first fluted strip may include: a strip having a cross-sectional area with a cross-sectional length; a socket cross-section located at one end of the cross-sectional length of the cross-sectional area of the strip, the socket cross-section having an inner circular surface of a first diameter; and a ball cross-section located at an opposite end of the cross-sectional length of the cross-sectional area of the strip, the ball cross-section having an outer circular surface of a second diameter. The second diameter of the outer circular surface of the ball cross-section may be less than or approximately equal to the first diameter of the inner circular surface of the socket cross-section such that the ball cross-section is configured to rotate within an adjacent socket cross-section of an adjacent fluted strip. As a result, the socket cross-section of the first fluted strip may be rotatably interlocked with a second ball cross-section of the first adjacent fluted strip, and the ball cross-section of the first fluted strip may be rotatably interlocked with a second socket cross-section of the second adjacent fluted strip facilitating the wrapping of the resulting flexible wrap of rotatable interlocking fluted strips around an object.

Advantages will become more apparent to those skilled in the art from the following description of the preferred embodiments which have been shown and described by way of illustration. As will be realized, the system is capable of other and different embodiments, and their details are capable of modification in various respects. Accordingly, the drawings and description are to be regarded as illustrative in nature and not as restrictive.

DETAILED DESCRIPTION

Figure 1A:
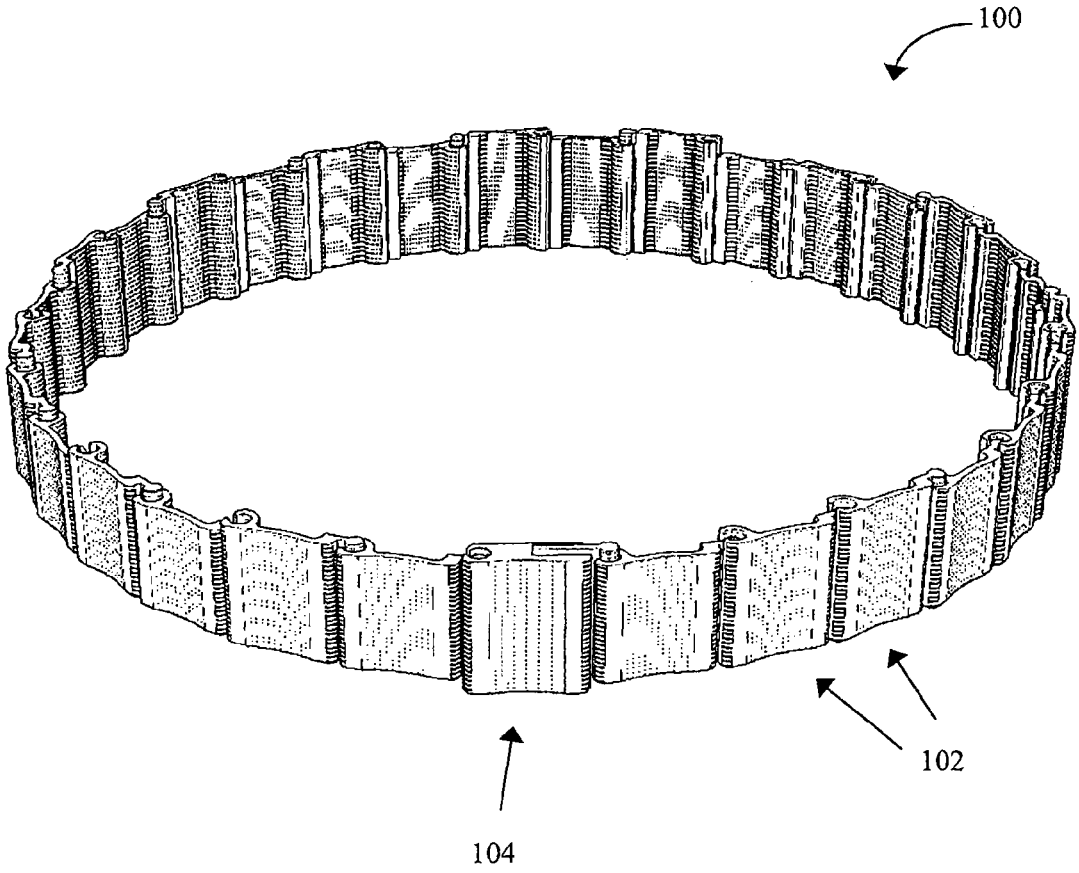
FIGS. 1A and 1B illustrate a perspective view and a top view, respectively, of an exemplary flexible wrap of rotatably interlocking fluted strips.

A flexible wrap of rotatably interconnected fluted strips is provided. Each interlocking fluted strip may be rotatably interlocked with adjacent interlocking fluted strips to form the flexible wrap. Each interlocking fluted strip may have cross-sectional areas having a substantially similar shape(s) and/or size, such as similarly shaped socket cross-sections and ball cross-sections discussed herein.

Each interlocking fluted strip may include a cross-sectional area having a socket means on one end and a ball means on the other end. The socket means may lockingly accept a ball means of an adjacent fluted strip. The ball means may be lockingly accepted by a socket means of a second adjacent strip. The socket means and ball means may also be configured to allow two adjacent, interlocked fluted strips to longitudinally rotate with respect to one another after being interconnected.

In one aspect, the socket means of a first fluted strip may include a cross-section having an inner surface sized to rotatably accept a corresponding cross-section having an outer surface of a ball means of an adjacent fluted strip. As an example, the socket means may include a cross-section having a circular inner surface of a first diameter. The ball means may include a cross-section having a circular outer surface of a second diameter. The second diameter of the circular outer surface of the ball means may be less than or approximately equal to the first diameter of the circular inner surface of the socket means.

As a result, the ball means of a first fluted strip may slide into the socket means of a second and adjacent fluted strip during assembly of the flexible wrap. After two fluted strips are interconnected, the ball means of the first fluted strip may be rotatable within the socket means of the adjacent fluted strip, giving the flexible wrap flexibility. In one embodiment, the surface(s) of the ball means may form clearance fits with the corresponding surface(s) of the socket means, further facilitating rotation between adjacent fluted strips and the wrapping of the flexible wrap around an object.

In another aspect, the socket means of a fluted strip may be configured to lockingly accept the ball means of an adjacent fluted strip. The socket means may interconnect with a ball means of the adjacent fluted strip in a secure manner such that the two adjacent fluted strips remain firmly interconnected after assembly.

The socket means may include a cross-section having two curved arms that form the circular inner surface, and an opening between the ends of the two curved arms of a first length. The ball means of an adjacent fluted strip may include or be interconnected with an arm having a cross-section of a second length. The second length of the cross-section of the arm may be less than or approximately equal to the first length of the opening between the ends of the two curved arms.

After the ball means of a fluted strip is slid into the socket means of an adjacent fluted strip during assembly, the two curved arms of the cross-section of the socket means may operate to "hold" the ball means and "lock" the two fluted strips together. In one embodiment, the cross-section of the arm may form a clearance fit with the opening between the ends of the two curved arms of the socket means of an adjacent fluted strip.

In another embodiment, the opening between the ends of the two arms of the socket means may be off-set or at an angle with respect to a longitudinal axis of the cross-sectional area of the fluted strip. As a result, greater rotation of the arm cross-section and the ball means of a fluted strip within the socket means of an adjacent fluted strip may be facilitated.

Experimentation during the development of the present embodiments revealed that a solid body for the fluted strips may create weight issues. For instance, issues may arise with assembly of the flexible wrap, wrapping the flexible wrap around an object, and/or supporting or affixing the flexible wrap in place with respect to the object.

Therefore, each interlocking fluted strip may further include a strip or body portion between the socket means and the ball means. The strip or body portion may be configured to have a slender width, thereby reducing the weight of the fluted strips as compared to some of the earlier embodiments of the inventor, such as the embodiments disclosed in U.S. Provisional Application Ser. No. 61/202,640, which is incorporated herein by reference in its entirety. The low weight of the preferred fluted strips may further reduce the cost of manufacture and shipping. The reduced weight of the fluted strips may further make on-site assembly easier, and enhance durability and longevity of an assembled flexible wrap after placement around an object.

The interlocking fluted strips may be manufactured from extruded aluminum, or a tinted polymer plastic. For a durable exterior coating, the aluminum may be finished with an anodization process, such as for color and protection from the elements. Alternative or additional materials may be used.

Noted above, a set of the rotatably interconnected fluted strips may form a flexible wrap that may be wrapped around an object, such as a pillar, post, pole, garbage can, tree, storm drain, or other object. In one embodiment, a utility pole to lamp post conversion kit may be provided. The conversion kit may upgrade a pre-existing utility, telephone, and/or other pole that is exposed to environmental conditions and other causes of degradation.

The conversion kit may include one or more flexible wraps of rotatably interlocking fluted strips. The interlocking fluted strips may be rotatably interconnected with one another to surround a diameter of the utility pole. Each flexible wrap may be held in place longitudinally with respect to the utility pole by a mounting device which is formed to the desired inside diameter of the wrap and attached directly to the object. After which, the wrap and mounting device may be encapsulated by one or more covering rings.

In one embodiment, the conversion kit may include five major components—a base ring, a middle ring, a cap ring, and two sets of interlocking fluted strips to form two flexible wraps. A bottom wrap of interlocking fluted strips may be positioned between the base ring and the middle ring. A top wrap of interlocking fluted strips may be positioned between the middle ring and the cap ring.

The interlocking fluted strips of the conversion kit may be cut to any length. This may provide the consumer with the freedom to vary the proportions of the bottom and top sets of interlocking fluted strips to suit their needs. After the sets of interlocking fluted strips are assembled into flexible wraps, each may be wrapped around an object and affixed to the object, such as via an internal mounting device. In one embodiment, each flexible wrap will only contact the mounting device and not the object it is wrapping. The mounting device will support the wrap and help and level the wrap in the event that the object, such as a utility pole, is at a slight angle.

Each set of interlocking fluted strips may include an individual fluted strip designed to join in the middle of the fluted strip assembly. The "locking" individual fluted strip may have two halves that are assembled together into a single piece, either with or without a locking screw. This may facilitate wrapping the set of interlocking fluted strips around the object (and the mounting device) and then interconnecting the two ends of the set of interlocking fluted strips such that the set remains wrapped around the object.

After which, the base, middle, and cap rings may be affixed to the object to secure the edges of the flexible wrap to the object. This may provide protection to the object from the elements, as the rings may prevent water and snow from leaking into the areas between the object and the fluted strips.

The base, middle, and cap rings may each be configured to have two pieces and be sized in incremental diameters to fit a variety of pole and/or pillar sizes. The base, middle, and cap rings may be physically attached to the pillar such that each ring is held in place longitudinally with respect to the pillar. Each ring may be bolted or screwed onto the pillar, and may include one or more thread sets that facilitate attachment of the ring to the pillar.

Once wrapped around an object, the conversion kit may be configured to have an exterior that presents the appearance of a lamp post. Additional decorative lighting products, banner arms and plant hangers may be mounted onto the completed lamp post protective cover. Power may be run to power any light fixtures attached to the lamp post protective cover. The exterior of a completed conversion kit may be substantially water tight to provide further protection to the object.

One advantage of having two flexible wraps of rotatably interlocked fluted strips may be the easy replacement of individual flexible wraps or individual fluted strips within either flexible wrap. One flexible wrap or an individual fluted strip(s) of the flexible wrap may be damaged while the other flexible wrap remains unharmed. For instance, a bottom flexible wrap, or a certain side thereof, may be more prone to vehicular damage than a top flexible wrap.

The conversion kit may be especially useful in towns that are unable to remove overhead lines supported by a utility and/or telephone pole. The conversion kit may provide an affordable, efficient, and effective solution for solving the problem of unsightly and degrading utility poles. Adding lamp posts to a sidewalk cluttered with utility poles may be undesirable. For various reasons, a town may be unable to bury power lines, such as due to hydraulic pressure from a river or other water way.

A template to wrap each pole was designed by the inventor. Eventually, over a period of time these concepts were developed into the conversion kit disclosed herein. For instance, one earlier exemplary design for a cross-sectional area of an interlocking fluted strip is disclosed in related U.S. Provisional Application No. 61/202,640. Through trial and error, the additional exemplary designs of the interlocking fluted strips disclosed herein were achieved. The preferred designs enhance assembly and manufacture by reducing the weight of the fluted strips, as well as reducing the amount of material required for each fluted strip.

I. Exemplary Flexible Wrap

FIG. 1A illustrates an exemplary flexible wrap 100 of rotatably interlocking fluted strips 102. The flexible wrap 100 may include a plurality of rotatably interlocking fluted strips 102. Each of the rotatably interlocking fluted strips 102 may rotatably interlock with adjacent interlocking fluted strips 102 that make up the flexible wrap 100. Each of the rotatably interlocking fluted strips 102 may have a substantially similar, or even the same, cross-sectional shape and/or size.

The flexible wrap 100 may be wrapped around an object, such as for protective and/or shielding purposes. A locking fluted strip 104 may facilitate wrapping and then locking the flexible wrap 100 around an object.

As explained further below in more detail, each of the rotatably interlocking fluted strips 102 may include a socket cross-section located at one end and a ball cross-section located at the opposite end. The socket cross-section of each fluted strip 102 may be configured to have a circular inner diameter sized to accept a second ball cross-section of an adjacent fluted strip. The ball cross-section of each fluted strip 102 may be configured to have a circular outer diameter sized to be accepted by a second socket cross-section of a second adjacent fluted strip. As a result, when the plurality of rotatably interlocking fluted strips 102 are interconnected, the ball cross-section of each fluted strip may may be rotatable within the socket cross-section of an adjacent fluted strip—facilitating wrapping the resulting flexible wrap 100 of rotatable interlocking fluted strips 102 around an object.

Figure 1B:
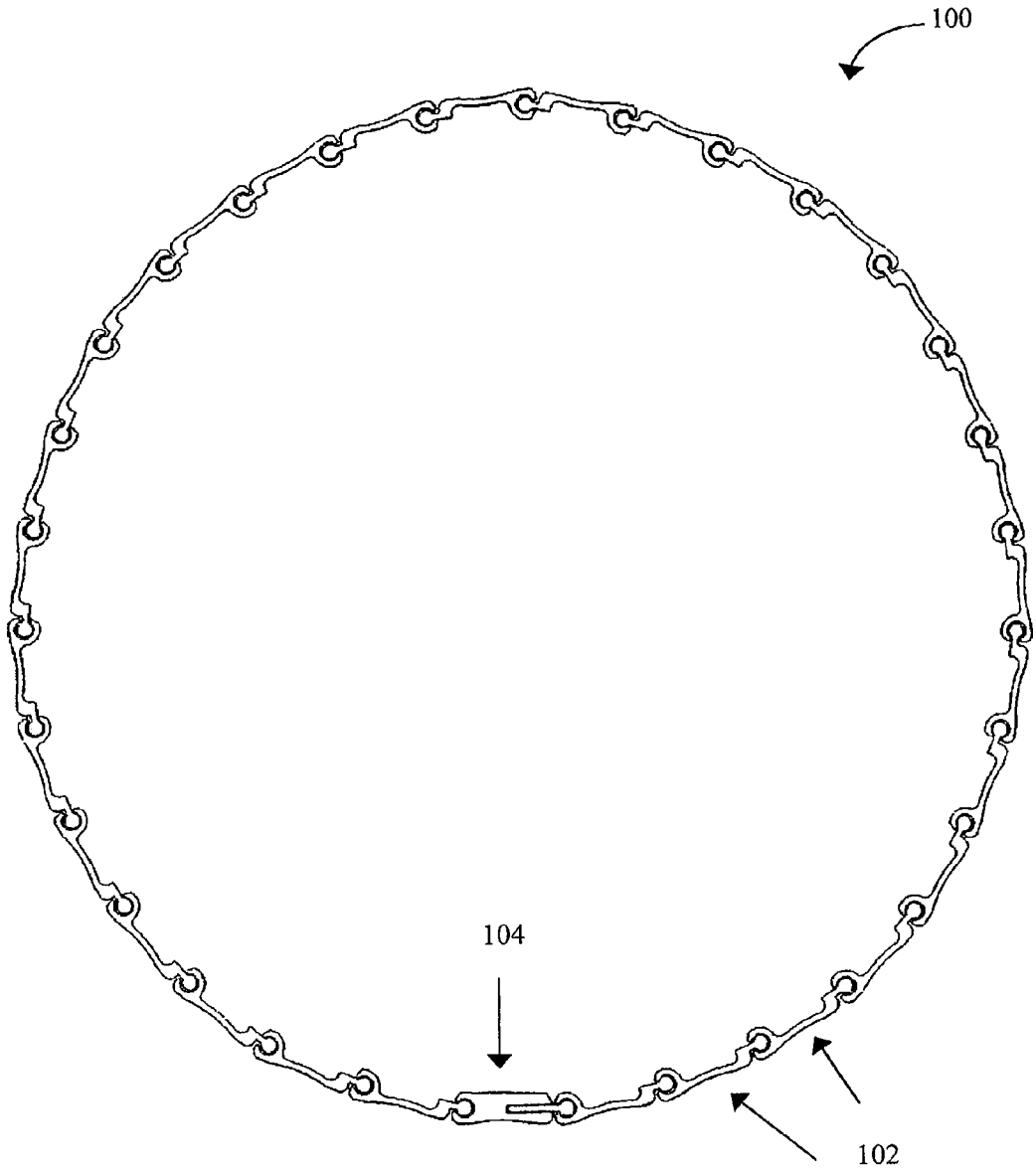

FIG. 1B illustrates a top view of the exemplary flexible wrap 100 of rotatably interlocking fluted strips 102. As shown, the flexible wrap 100 may be locked together by the locking fluted strip 104.

II. Exemplary Interlocking Fluted Strips

Figure 2A:
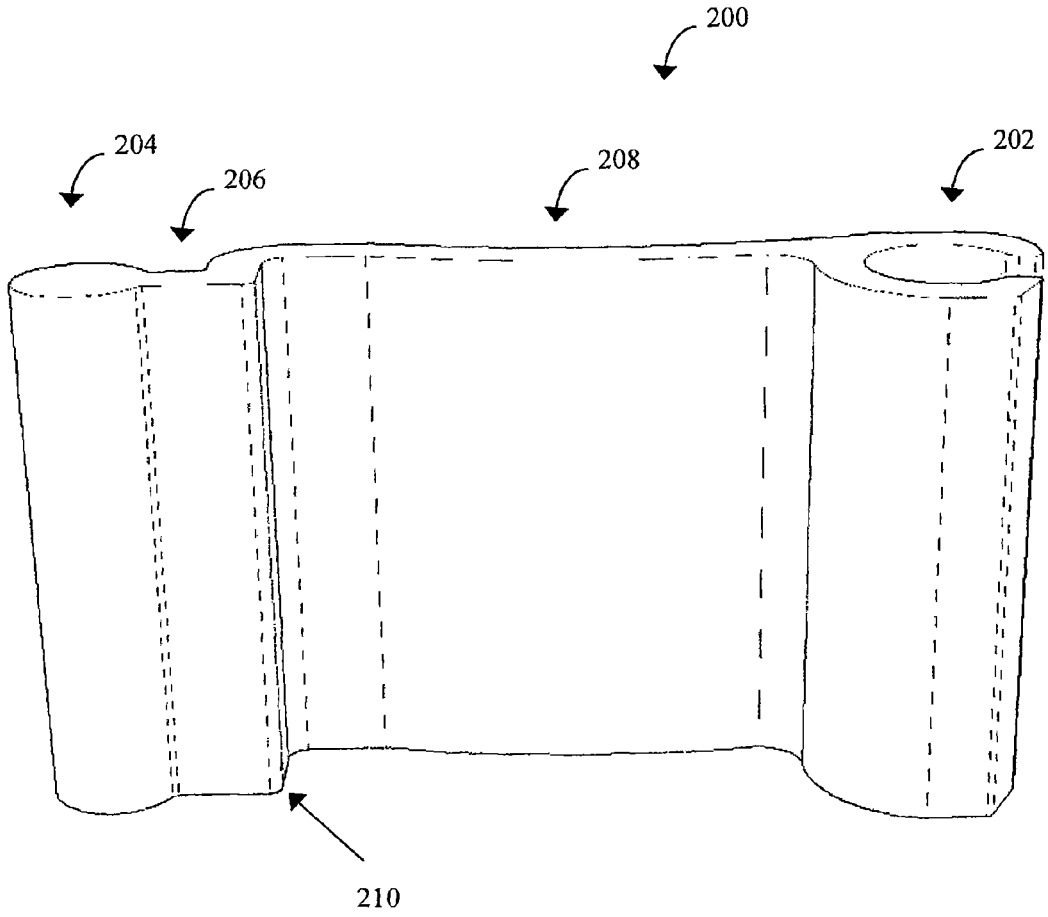
FIGS. 2A and 2B illustrate an interior view and an exterior view, respectively, of an exemplary rotatably interlocking fluted strip.
Figure 2B:
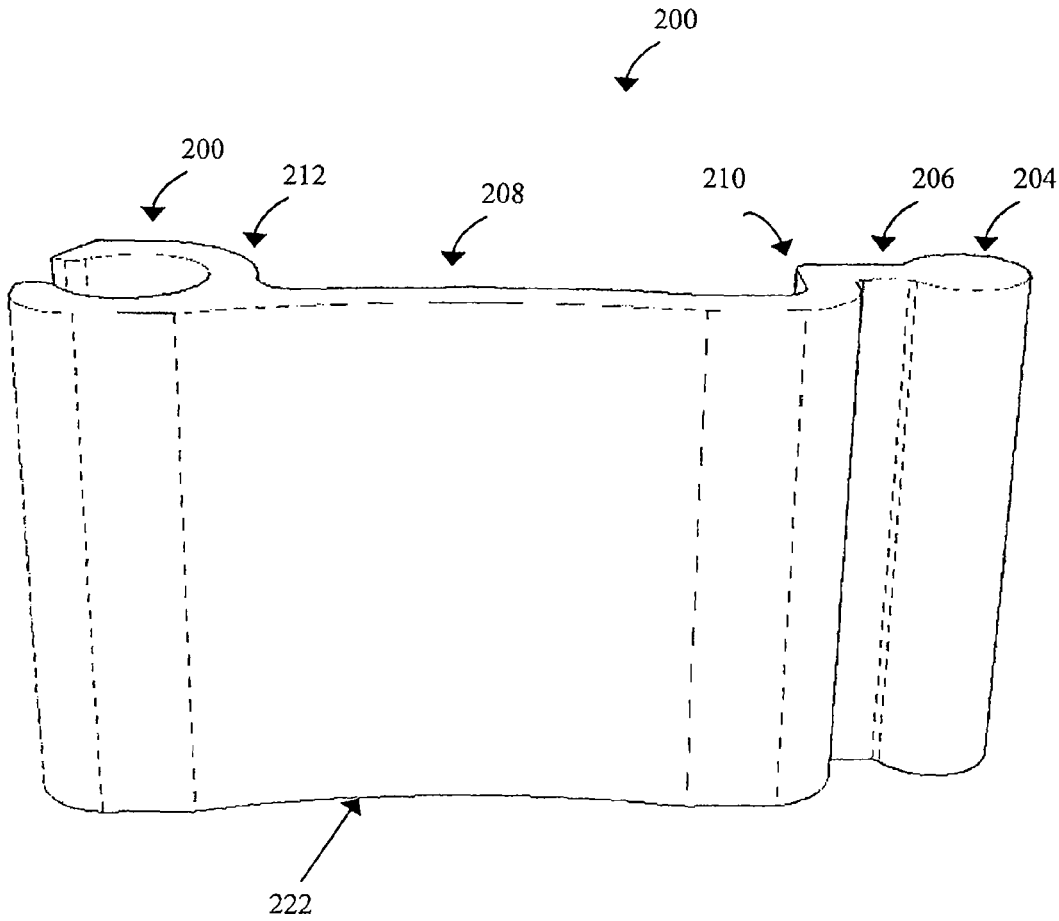

FIG. 2A illustrates an exemplary interior view, and FIG. 2B illustrates an exemplary exterior view, of an exemplary rotatably interlocking fluted strip 200. The rotatably interlocking fluted strip 200 may have a socket cross-section 202 at a first end of a strip 208 of the fluted strip 200 and a ball cross-section 204 at an opposite and second end of the strip 208. The fluted strip 200 may include additional, fewer, or alternate components.

The socket cross-section 202 may extend along at a longitudinal length of at least a portion of the first end of the strip 208, such as in a vertical direction. Likewise, the ball cross-section 204 may extend along a longitudinal length of at least a portion of the second end of the strip 208, such as in a vertical direction.

The socket cross-section 202 may include a cross-section having a circular surface. The ball cross-section 204 may include a cross-section having a corresponding circular surface. The socket cross-section 202 may be configured to lockingly accept a ball cross-section 204 of an adjacent and similarly shaped fluted strip, holding the two fluted strips together. The socket cross-section 202 may further be configured to rotatably accept the ball cross-section 204 of the adjacent fluted strip, facilitating rotation between the two interconnected fluted strips.

In one embodiment, the ball cross-section 204 may be attached to the strip or body portion 208 of the fluted strip 200 via an arm 206. The arm 206 may be interconnected with the strip 208 via a 90 degree elbow 210. Both the arm 206 and the elbow 210 may extend longitudinally along at least a portion of the vertical length of the strip 208.

FIG. 2B shows the exterior of the fluted strip 200. The exterior of the strip 208 may have a concave exterior 222 for at least a portion of the longitudinal length of the strip 208. After assembly with other fluted strips into a flexible wrap, and then being wrapped around an object, the fluted strip 200 may make contact with the object along a curved arm 212 of the socket cross-section 202.

The curved arm 212 of the socket cross-section 202 may be sized to facilitate holding the ball cross-section of a second adjacent fluted strip sufficiently far from the object to facilitate rotation between the socket cross-section 202 and the ball cross-section of the second adjacent fluted strip during and/or after being wrapped around the object.

Figure 3A:
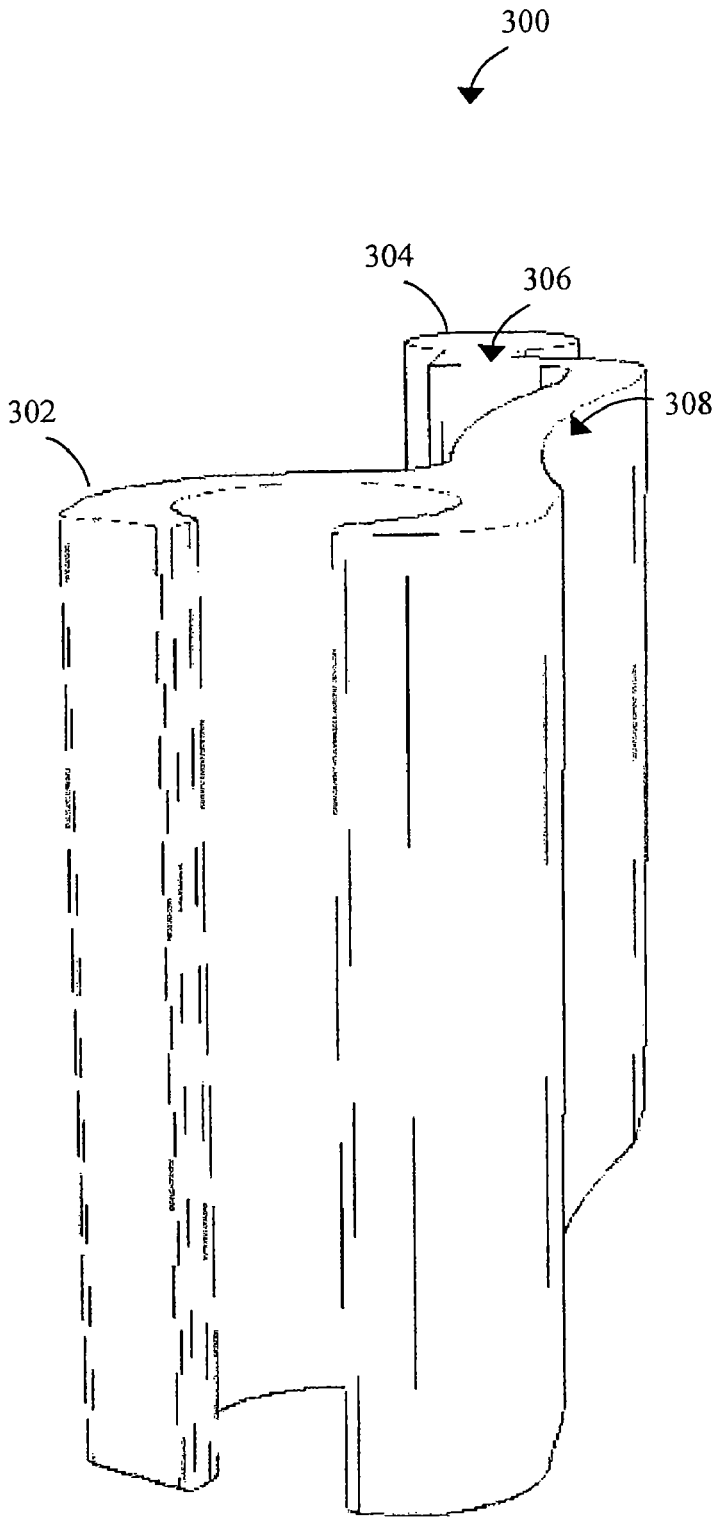
FIGS. 3A and 3B illustrate a front view and a back view, respectively, of the exemplary rotatably interlocking fluted strip.
Figure 3B:
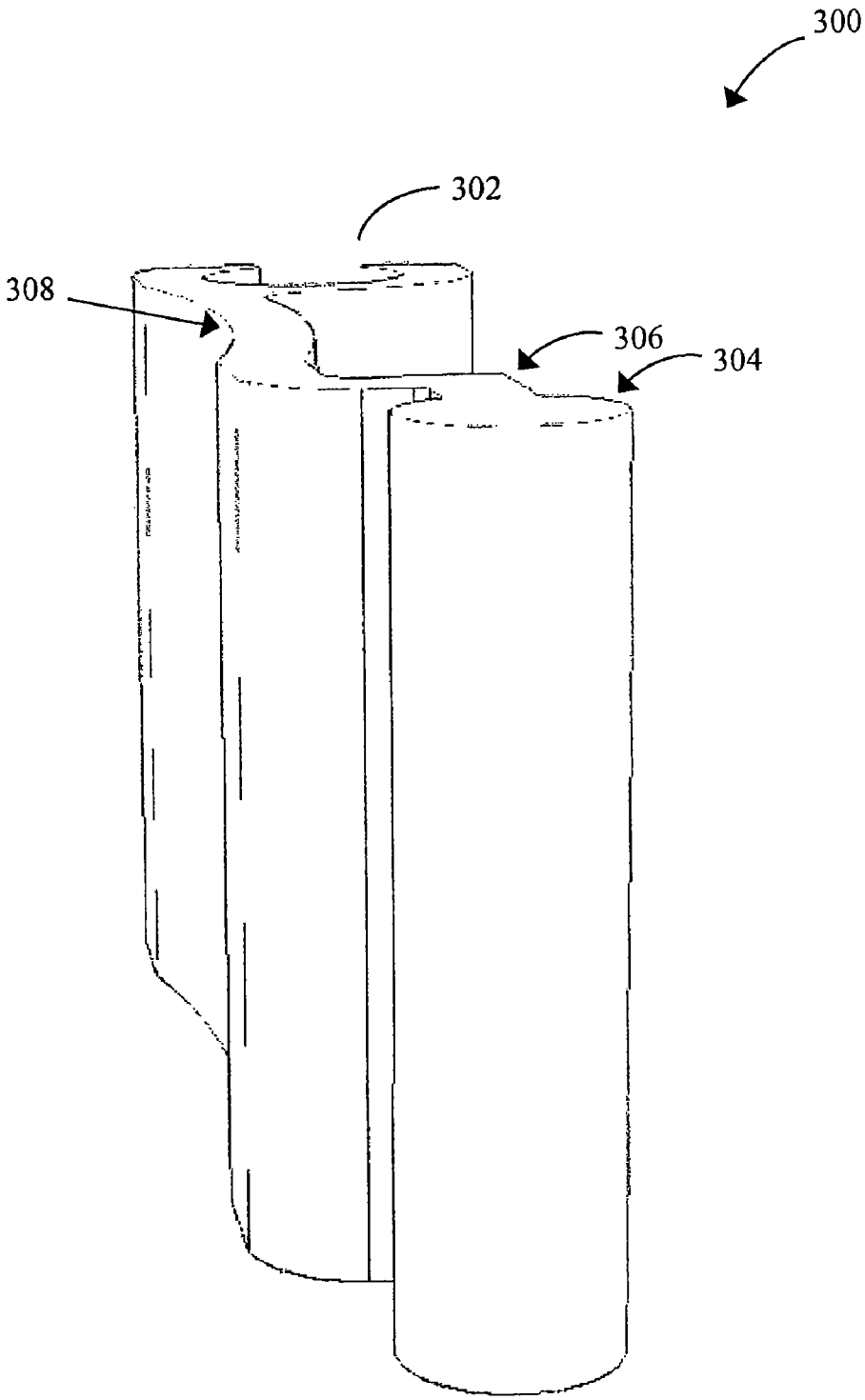

FIGS. 3A and 3B illustrate front and back views of the exemplary rotatably interlocking fluted strip 300. The rotatably interlocking fluted strip 300 may include a socket cross-section 302 and a ball cross-section 304, each of which may extend along a back and a front longitudinal edge of the interlocking fluted strip 300.

The interlocking fluted strip 300 may include a strip or body portion 308 between the socket cross-section 302 and the ball cross-section 304. The strip 308 may have a concave exterior surface and a convex interior surface. The strip 308 may have a slender cross-sectional width to reduce the weight of the fluted strip 300, facilitating ease of assembly, durability, maintaining the flexible wrap in place, reduced weight, and reduced shipping and manufacturing costs, among other things. The interlocking fluted strip 300 may include additional, fewer, or alternate components.

III. Exemplary Cross-Sectional Area

Figure 4A:
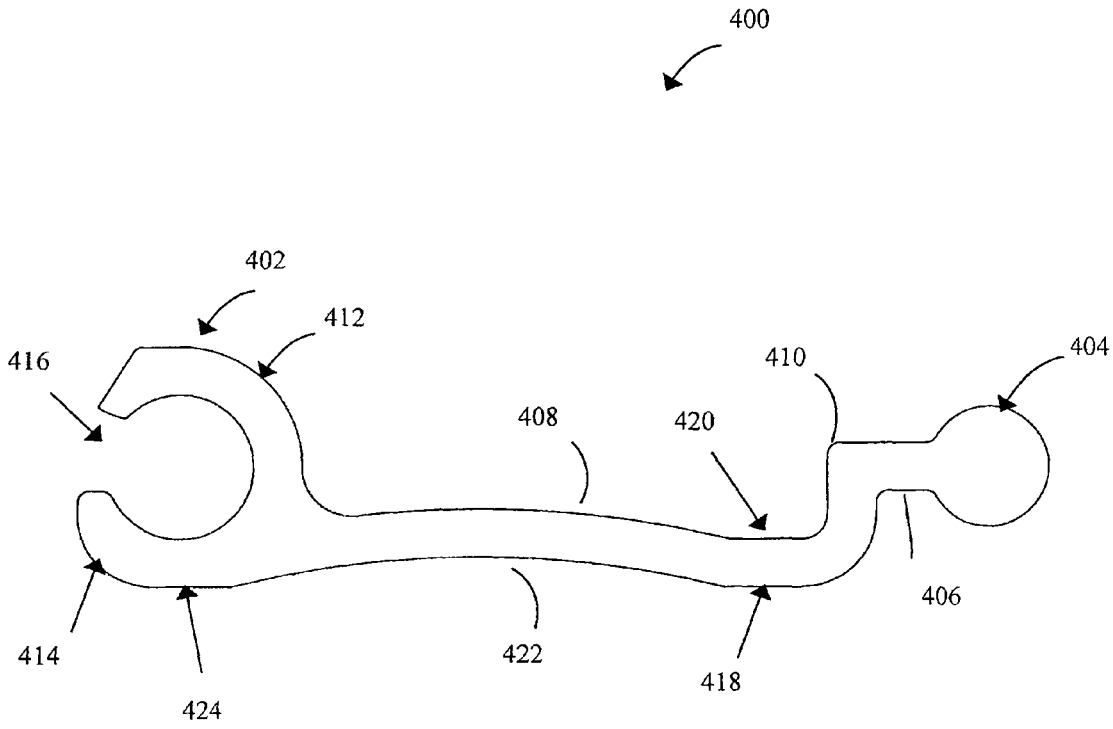
FIG. 4A illustrates a cross-sectional area of the exemplary rotatably interlocking fluted strip.

FIG. 4A illustrates an exemplary cross-sectional area for an exemplary interlocking fluted strip 400. The fluted strip 400 may include a socket cross-section 402, a ball cross-section 404, an arm 406, and a strip or body portion 408. The interlocking fluted strip 400 may include additional, fewer, or alternate components.

As shown, the socket cross-section 402 may be located at one end of the strip 408. The socket cross-section 402 may have a circular inner surface of a first diameter. The socket cross-section 402 may have two curved arms 412, 414 forming the circular inner surface. Between the two curved arms 412, 414 may be a gap or an opening 416 of a first length.

The ball cross-section 404 may be located at an opposite end of the strip 408 that is opposite of the socket cross-section 402. The ball cross-section 404 may have a circular outer surface of a second diameter. The ball cross-section 404 may be attached to the strip 408 via an arm 406. The arm 406 may have a width of a second length. The arm 406 may interconnect the ball cross-section 404 with the strip 408 via a 90 degree elbow 410.

The first diameter of the circular inner surface of the socket cross-section 402 may be greater than or approximately equal to the second diameter of the circular outer surface of the ball cross-section 404. The second length of the width of the arm 406 may be less than or approximately equal to the first length of the opening 416 between the two curved arms 412, 414 of the socket cross-section 402. As a result, a ball cross-section of an adjacent fluted strip, shaped similarly to the ball cross-section 404, may slide into the socket cross-section 402, and an arm of the adjacent fluted strip, shaped similarly to the arm 406, may slide into the opening 416 between the two curved arms 412, 414 of the socket cross-section 402 during assembly of the flexible wrap.

After interconnection, the ball cross-section of the adjacent fluted strip may rotate within the socket cross-section 402, and the socket cross-section 402 may operate to firmly hold the ball cross-section of the adjacent fluted strip and lock the adjacent fluted strips together. Once interlocked, the two adjacent fluted strips may be rotatable or swing with respect to each other along a longitudinal length of a front or back edge of each fluted strip.

In one embodiment, the surface(s) of the socket cross-section 402 of the fluted strip 400 may form only clearance fits with the surface(s) of the ball cross-section and the arm of the adjacent fluted strip. The surface(s) of the ball cross-section 404 and the arm 406 of the fluted strip 400 may form only clearance fits with the surface(s) of the socket cross-section of adjacent fluted strips. As a result, rotation between adjacent fluted strips may be facilitated. Further, the opening 416 between the arms 412, 414 of the socket cross-section 402 may be off-center with respect to a longitudinal axis of the strip 408, further facilitating rotation between adjacent fluted strips.

The exterior surface of the strip 408 may have a concave surface 422. The concave surface 422 may be in between two flat surfaces 424, 418. The interior surface of the strip 408 may be a convex surface ending with a flat surface 420 prior to the elbow 410. The curvature of the exterior concave surface and interior convex surface of the strip 408 may be the same such that width of the strip 408 is uniform over all or most of its length. Other shapes may be used.

In one embodiment, a radius of the inner diameter of the socket cross-section 402 may be approximately 0.15 inches. The gap of the socket cross-section 402 may cover an angle of approximately 23 degrees. The distance from the front of the gap to the innermost portion of the inner circular surface of the socket cross-section 402 may be approximately 0.313 inches.

The width of the strip 408 may be approximately 0.10 inches. The flat exterior portion 418, 420 of the strip 608 may have a length of approximately 0.20 inches. The arm 406 may have a width of approximately 0.10 inches, and a length of approximately 0.10 inches. The ball cross-section 404 may have a radius of approximately 0.125 inches. The fluted strip 400 may have a total length of approximately 2.50 inches.

The gap 416 between the curved arms 412, 414 of the socket cross-section 402 may have a width of approximately 0.157 inches. The gap 416 may facilitate insertion of a ball cross-section of an adjacent fluted strip into the socket cross-section 402. The reduced weight of the fluted strip 600 may make this design preferable over the other embodiments discussed herein. Other dimensions may be used.

Figure 4B:
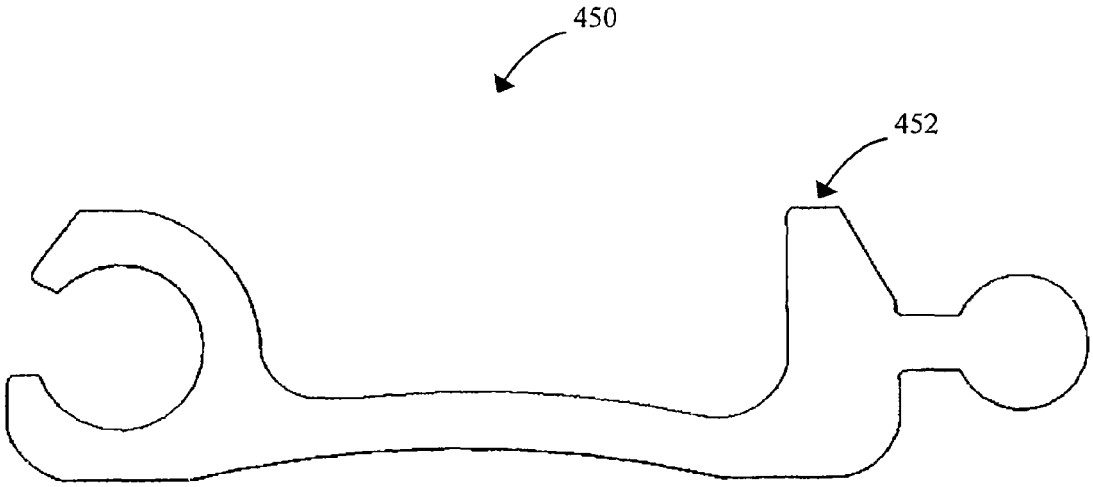
FIG. 4B illustrates a cross-sectional area for another exemplary rotatably interlocking fluted strip.

FIG. 4B illustrates an exemplary cross-sectional area for another exemplary interlocking fluted strip 450. In addition, to the socket cross-section and the ball cross-section discussed above with respect to FIG. 4A, the fluted strip 450 may include a protruding edge 452. However, testing of various embodiments revealed that a low weight fluted strip may be preferred. The protruding edge 452 adds to the weight of the fluted strip 450. Therefore, over time, the preferred embodiment has morphed from that disclosed in U.S. Provisional Application Ser. No. 61/202,640, to that of FIG. 4B, to the currently preferred embodiment of FIG. 4A.

IV. Locking Fluted Strip

Figure 5:
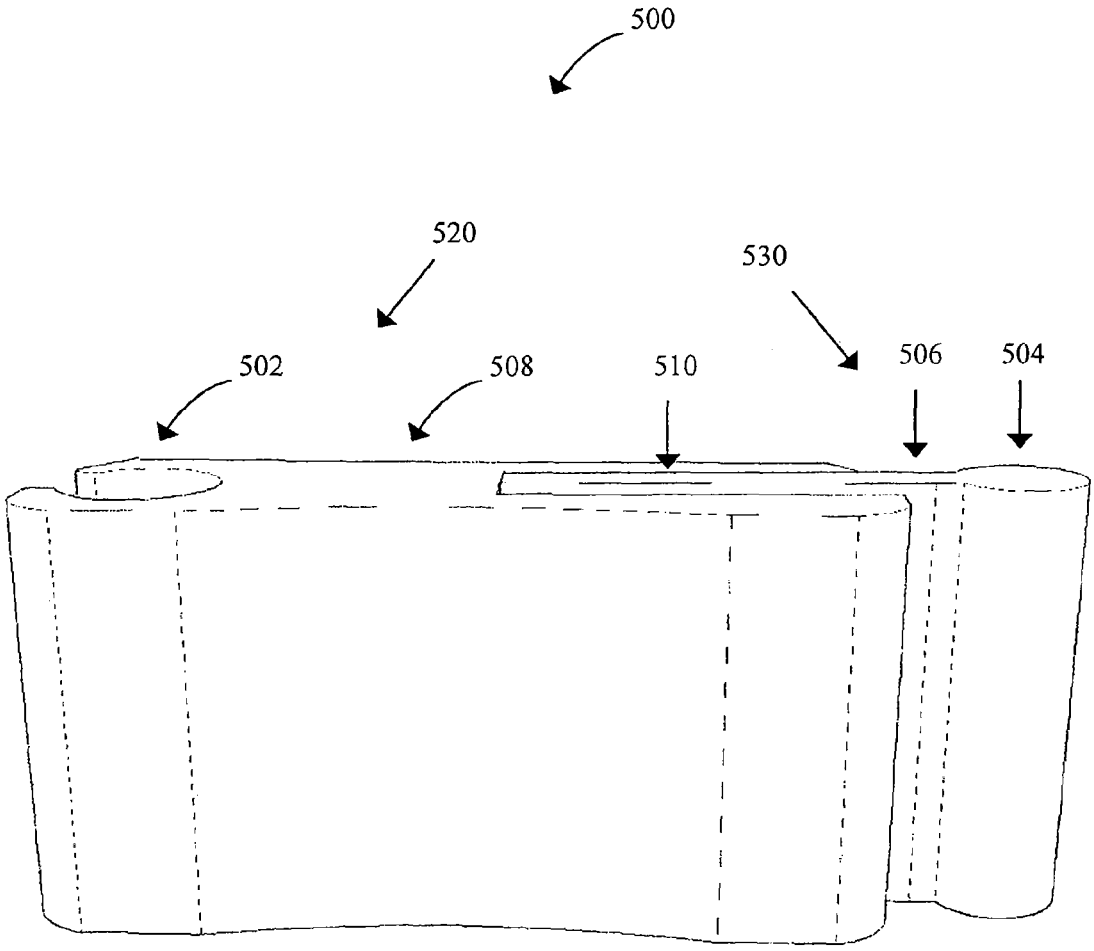
FIG. 5 illustrates an exemplary two-piece locking fluted strip.

FIG. 5 illustrates an exemplary two-piece locking fluted strip 500. The fluted strip 500 may include a first piece 520 and a second piece 530. The first piece 520 may include a socket cross-section 502, and a strip 508 portion. The second piece 530 may include a ball cross-section 504, an arm 506, and an elongated portion 510. The locking fluted strip 500 may include additional, fewer, or alternate components.

Each piece or half 520, 530 may have a length of approximately 1.25 inches. The two pieces 520, 530 may be shaped to mechanically fit together. For instance, the elongated portion 510 of the second piece 530 may be configured to function as a male component for locking insertion into a corresponding surface on the first piece 520 functioning as a female component.

After being assembled together, the two pieces 520, 530 may be firmly affixed to one another via a locking screw or bolt, or other interlocking means. This type of interlocking configuration for at least one fluted strip within a set of fluted strips may facilitate the wrapping of an assembled set of interlocking fluted strips around a pillar, such as a utility post, and then interconnecting the set of interlocking fluted strips such that they remain wrapped around the pillar.

Figure 6:
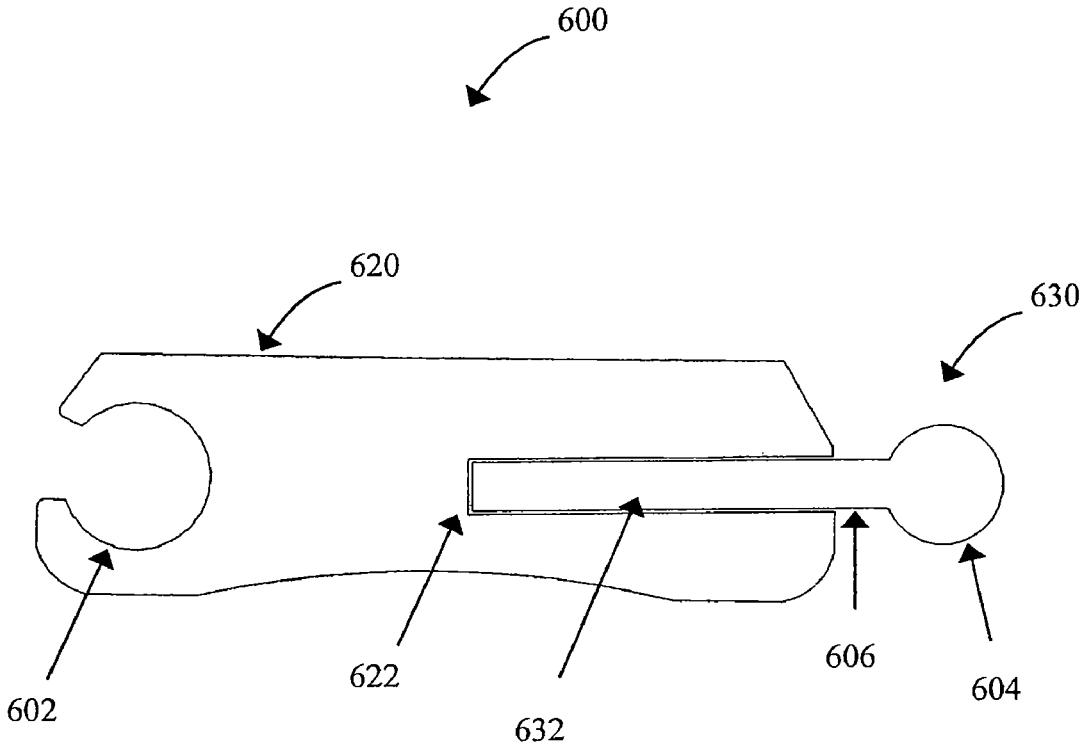
FIG. 6 illustrates a cross-sectional area of the exemplary two-piece locking fluted strip.

FIG. 6 illustrates an exemplary cross-sectional area for an exemplary locking fluted strip 600. The locking fluted strip 600 may include a first piece 620 and a second piece 630. The locking fluted strip 600 may include additional, fewer, or alternate components.

The first piece 620 may include a socket cross-section 602 and a female interior surface 622. The second piece 630 may include a ball cross-section 604, an arm 606, and a male exterior surface 632. The female interior surface 622 of the first piece 620 may have a shape corresponding to the male exterior surface 632 of the second piece 630 such that the male exterior surface 632 slides into the female interior surface 622 during assembly or the wrapping of the flexible wrap of interlocking fluted strips around an object.

V. Exemplary Conversion Kit

Numerous types of pre-existing pillars and other objects exist. Many conventional column wraps are inadequate to adjust to various size poles or other objects. For instance, utility and/or telephone poles are, of course, quite common. However, many of these poles are attached to various lines, such as power and telephone lines. In many downtown areas, these poles may be unsightly.

These poles may be subject to structural integrity degradation. Outdoor pillars are exposed to weather conditions, which may degrade the structural strength of the poles over time. Outdoor poles may also be prone to vehicle collision, causing damage as well. The degradation of the structural integrity of poles may create various problems, such as present safety risks or the risk of losing power and telephone services to the local community. However, the cost of replacing conventional utility poles may be expensive. Thus, extending the life of pre-existing utility poles may be beneficial.

Figure 7:
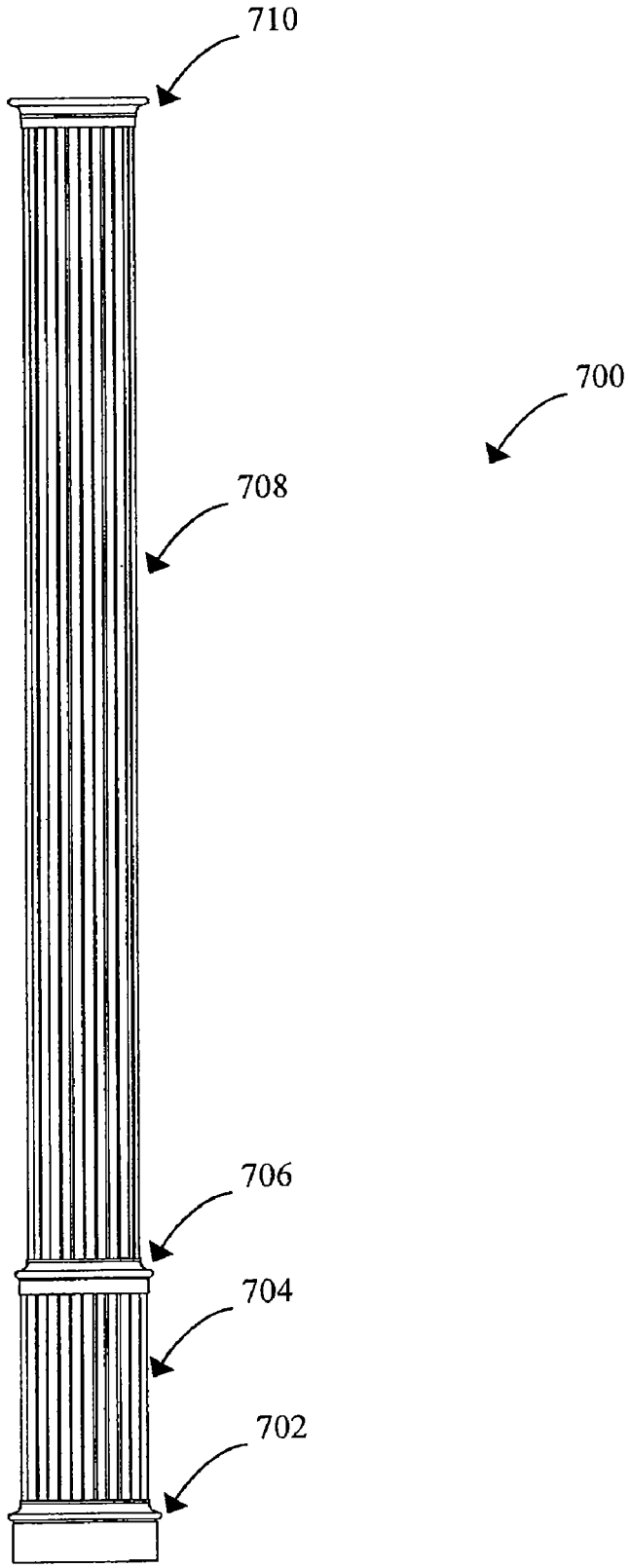
FIG. 7 illustrates an exemplary utility pole to lamp post conversion kit comprising a protective covering of two flexible wraps of rotatably interlocking fluted strips that are supported by base, middle, and cap covering rings.

In one embodiment, a utility pole to lamp post conversion kit is provided. FIG. 7 illustrates an exemplary protective covering of a utility pole to lamp post conversion kit 700 after being assembled. The conversion kit 700 may include a base ring 702, a bottom flexible wrap 704, a middle ring 706, a top flexible wrap 708, and a cap ring 710. The conversion kit may include additional, fewer, or alternate components.

The bottom flexible wrap 704 and top flexible wrap 708 may each include a plurality of rotatably interlocking fluted strips. Each flexible wrap 704, 708 may be wrapped around an object, and then locked around the object to form a shell around the object, such as via a "locking" fluted strip discussed above. Each flexible wrap 704, 708 may be held in place longitudinally with respect to the object via an internal mounting device for each piece, or alternatively by screws, bolts, posts, or other fasteners affixed to the object.

Each of the rings 702, 706, 710 may have two pieces configured to interconnect with one another. Each ring 702, 706, 710 may be sized to have a diameter to fit a utility pole or other pillar. Each piece of the rings 702, 706, 710 may have one or more threads for interconnection with the corresponding piece of the respective ring 702, 706, 710.

After the flexible wraps 704, 708 are attached to the object, the rings 702, 706, 710 may cover the top and bottom edges of the flexible wraps 704, 708 and provide further support to hold the flexible wraps 704, 708 in place with respect to the object. For instance, the base ring 702 may be attached to the object, covering the bottom edge of the bottom flexible wrap 704. The middle ring 706 may be attached to the object, covering the top edge of the bottom flexible wrap 704, and the bottom edge of the top flexible wrap 708. The cap ring 710 may be attached to the object, covering the top edge of the top flexible wrap 708.

As a result, the base ring 702, the bottom flexible wrap of rotatably interlocking fluted strips 704, the middle ring 706, the top flexible wrap of rotatably interlocking fluted strips 708, and the cap ring 710 may be interlocked together to provide a longitudinal protective cover for the utility pole. Together, the exteriors of the base ring 702, the bottom flexible wrap 704, the middle ring 706, the top flexible wrap 708, and the cap ring 710 may have exteriors configured to look like a lamp post or other aesthetically pleasing object.

In one embodiment, the conversion kit may provide protection to either outdoor or indoor pillars. The conversion kit may include one or more flexible wraps of rotatably interlocking fluted strips. The conversion kit and flexible wraps may be used with other applications, including surrounds for storm drains, garbage cans, piping, beams, trees, and other objects.

VI. Exemplary Covering Rings

Figure 8:
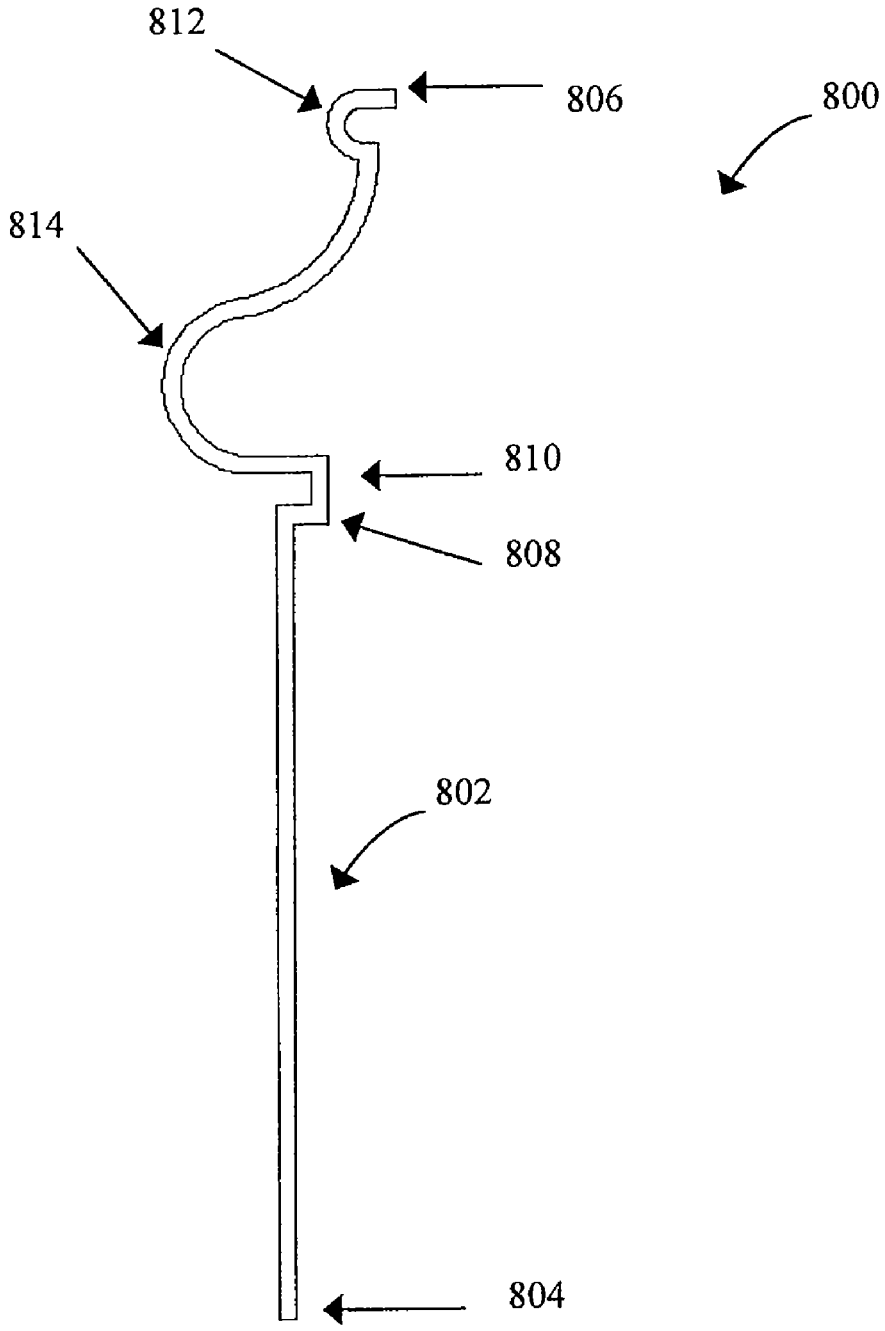
FIG. 8 illustrates a cross-sectional area of an exemplary base ring.

FIG. 8 illustrates a cross-sectional area of an exemplary base ring 800. The base ring 800 may have two pieces configured to interconnect with one another. The base ring 800 may be sized to have a curved inner diameter to fit around an object. Each piece may have threads or other means for interconnecting with the object and/or each other. The base ring 800 may have additional, fewer, or alternate components.

In one embodiment, the base ring 800 may have a straight portion 802 of approximately 6.00 inches from a bottom 804 to an elbow 808, and a length of approximately 3.25 inches from the elbow 808 to the top 806. The elbow 808 may have a flat interior surface 810 of approximately 0.50 inches. A first curved surface 812 may have an outer diameter of approximately 0.50 inches. A second curved surface 814 may have an outer diameter of approximately 1.25 inches. The base ring 800 may have a cross-sectional width of approximately 0.10 inches. Other dimensions, shapes, and configurations may be used.

Figure 9:
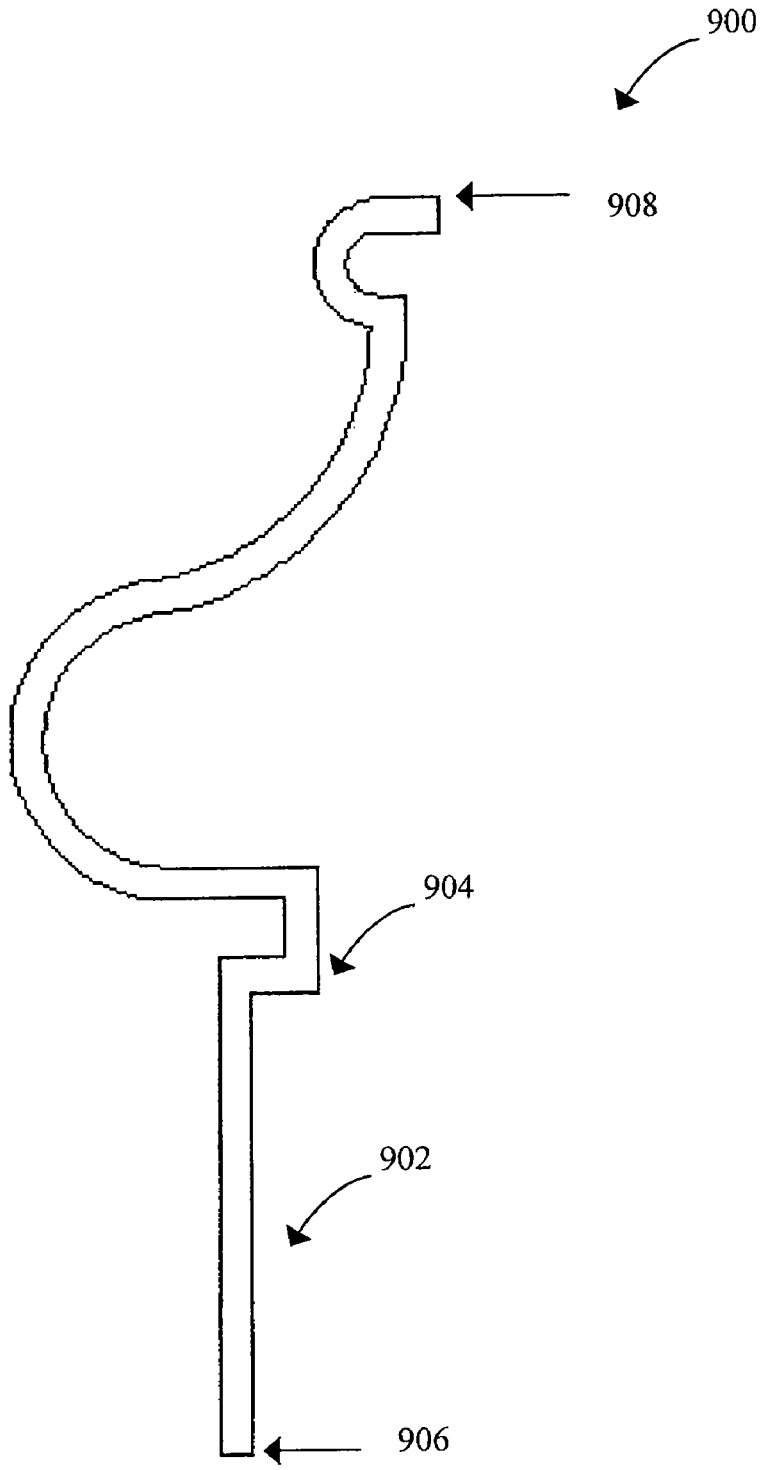
FIG. 9 illustrates a cross-sectional area of an exemplary middle ring.

FIG. 9 illustrates a cross-section of an exemplary middle ring 900. The middle ring 900 may have two pieces configured to interconnect with one another. The middle ring 900 may be sized to have a curved inner diameter to fit around an object. Each piece of the middle ring 904 may have threads for interconnecting with the object and/or each other. The middle ring 900 may have additional, fewer, or alternate components.

In one embodiment, the middle ring 900 may have a straight portion 902 of approximately 2.00 inches between a bottom 906 and an elbow 904. The vertical distance from the elbow 904 to the top 908 may be approximately 3.25 inches. The middle ring 900 may have a cross-sectional width of approximately 0.10 inches. Other dimensions, shapes, and configurations may be used.

Figure 10:
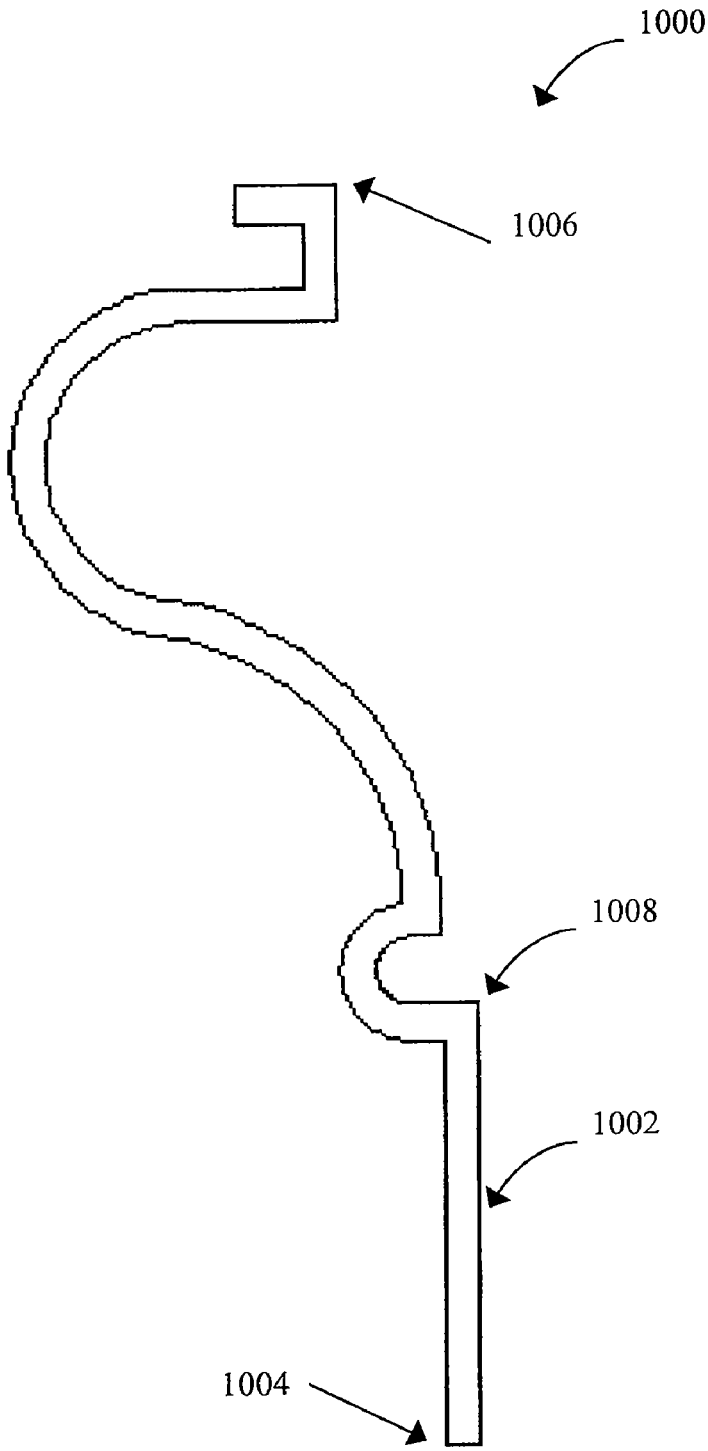
FIG. 10 illustrates a cross-sectional area of an exemplary cap ring.

FIG. 10 illustrates a cross-section of an exemplary cap ring 1000. The cap ring 1000 may have two pieces configured to interconnect with one another. The cap ring 1000 may be sized to have a curved inner diameter to fit around an object. Each piece of the cap ring 1000 may have threads for interconnecting with the object and/or each other. The cap ring 1000 may include additional, fewer, or alternate components.

In one embodiment, the cap ring 1000 may have a straight portion 1002 having a length of approximately 1.50 inches between a bottom 1004 and an elbow 1008. The vertical distance from the elbow 1008 to the top 1006 may be approximately 3.25 inches. Other dimensions, shapes, and configurations may be used.

VII. Exemplary Mounting Device

Figure 11:
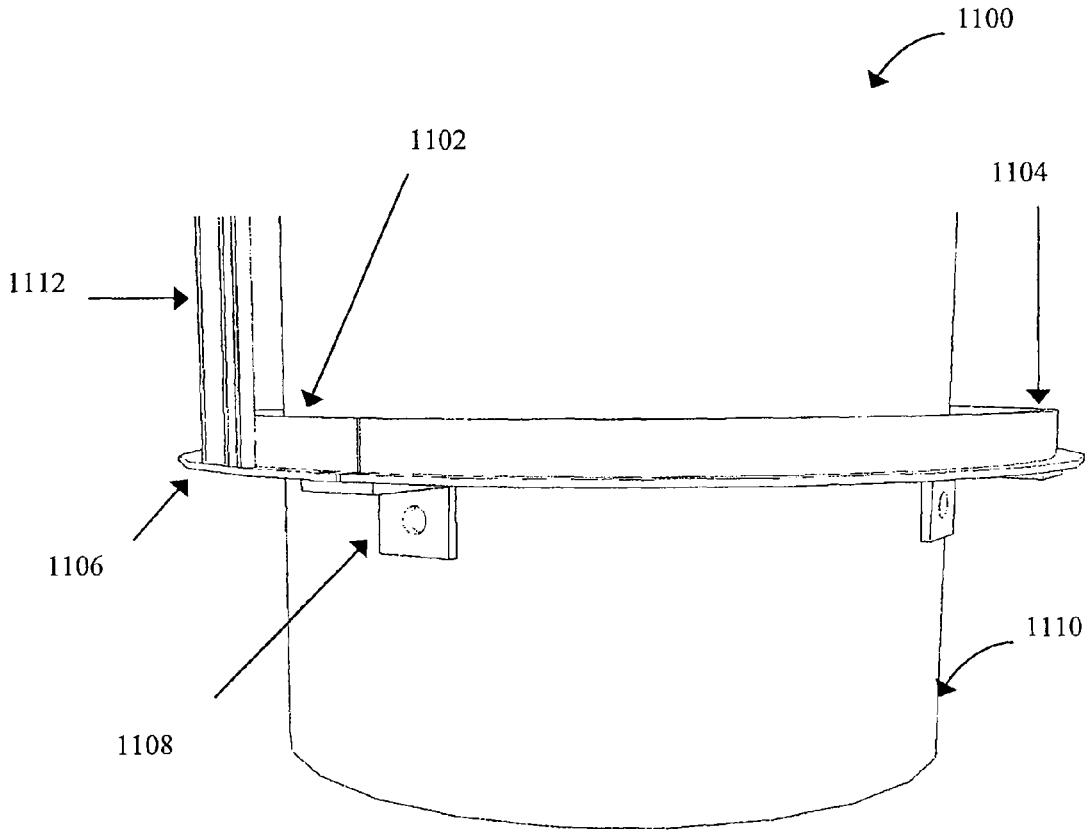
FIG. 11 illustrates an exemplary internal mounting device.

FIG. 11 illustrates an exemplary internal mounting device 1100. The mounting device 1100 may include two pieces or halves 1102, 1104, and L-shaped supports 1108. The mounting device 1100 may include additional, fewer, or alternate components.

A number of L-shape supports 1108 may be directly attached to an object 1110, such as via screws, bolts, or other fasteners. One flat side of a L-shaped support 1108 may align with the object 1110. A second flat side of the L-shape support 11108 may extend from the surface of the object 1110 and support one or two of the halves 1102, 1104.

The halves 1102, 1104 may each include a flange 1106. The ends of each half 1102, 1104 may meet with the ends of the other half 1104, 1102, such as on top of the L-shaped support 1108. The flange 1106 of the completed internal mount device 1100 may support the flexible wrap of fluted strips (exemplary fluted strip 1112 is shown) vertically with respect to the object 1110. As shown, the fluted strip 1112 may not make contact with the object 1110, but rather may be positioned away from the object 1110. Other internal mounts may be used, including those in which the fluted strip 1112 may make contact with the object 1110.

VIII. Exemplary Method

In one embodiment, a utility or telephone post may be converted to a lamp post. For instance, a protective shell or covering may be wrapped around the utility post. The protective covering may be configured to have an exterior resembling that of a lamp post.

Briefly, an exemplary method of converting a pillar or other object will be explained. The method may include attaching one or more mounting devices to a pillar. Each mounting device is formed to the desired inside diameter of the wrap and attached directly to the object.

The method may include rotatably interconnecting a plurality of fluted strips to form a flexible wrap of rotatably interlocked fluted strips. Each of the fluted strips may have a means for rotatable interconnection with adjacent fluted strips.

The method may include wrapping the flexible wrap of rotatably interlocking fluted strips around the pillar in a manner such that the flexible wrap covers a longitudinal length of an exterior of the pillar. The method may include vertically positioning the flexible wrap around the pillar with respect to the mounting device such that the flexible wrap is longitudinally supported with respect to the pillar. In one embodiment, the flexible wrap may only contact the mounting device, and not the pillar it is wrapping. The mounting device may support the wrap, and help plumb and level the wrap in the event the pillar is at a slight angle.

After which, the method may comprise attaching one or more rings on the pillar to cover the top and bottom edges of the flexible wrap. The rings may further support the flexible wrap with respect to the pillar and provide further protection to the pillar. The rings may encapsulate both the internal mounting device and the flexible wrap.

While the preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

It is therefore intended that the foregoing detailed description be regarded as illustrative rather than limiting, and that it be understood that it is the following claims, including all equivalents, that are intended to define the spirit and scope of this invention.

What is claimed is:

1. An interlocking fluted strip for rotatably interlocking with adjacent interlocking fluted strips having similarly shaped socket and ball cross-sections to form a flexible wrap, the interlocking fluted strip comprising:

a strip having a first end and a second end, the first end being opposite the second end;

a socket cross-section located at the first end of the strip, the socket cross-section comprising an inner curved surface having a first diameter; and an arm cross-section located at the second end of the strip, the arm cross-section extending at an angle bent away from the second end of the strip; and, a ball cross-section extending from the arm cross-section, the ball cross-section comprising an outer curved surface having a second diameter, the second diameter of the outer curved surface of the ball cross-section being less than or approximately equal to the first diameter of the inner curved surface of the socket cross-section; and, wherein (1) the socket cross-section of the interlocking fluted strip is configured to rotatably interlock with a second ball cross-section of a second interlocking fluted strip, and (2) the ball cross-section of the interlocking fluted strip is configured to rotatably interlock with a third socket cross-section of a third interlocking fluted strip such that the interlocking fluted strip is rotatably interlocked with the second interlocking fluted strip and also rotatably interlocked with the third interlocking fluted strip to facilitate wrapping the resulting flexible wrap around an object.

2. The interlocking fluted strip of claim 1, wherein the arm cross-section is configured to have a first width.

3. The interlocking fluted strip of claim 2, the socket cross-section comprising two curved arms with an opening between their ends, the opening being greater than or approximately equal to the first width of the arm cross-section to facilitate acceptance by the socket cross-section of a second arm cross-section of the second interlocking fluted strip.

4. The interlocking fluted strip of claim 3, wherein the opening between the two curved arms is off-axis with respect to a cross-sectional length of the strip of the interlocking fluted strip to facilitate rotation between the interlocking fluted strip and the second interlocking fluted strip.

5. The interlocking fluted strip of claim 1, wherein the strip comprises a mid-portion having a concave exterior surface and the arm cross-section comprises an elbow.

6. The interlocking fluted strip of claim 1, wherein the interlocking fluted strip is configured to have two halves that join in a middle portion of the strip to facilitate the wrapping and then locking of the flexible wrap around the object.

7. A flexible wrap of rotatably interlocking fluted strips, the flexible wrap comprising:

a set of interlocking fluted strips, each interlocking fluted strip within the set having a substantially similar cross-sectional shape, the set of interlocking fluted strips comprising a first interlocking fluted strip, a second interlocking fluted strip, and a third interlocking fluted strip, each interlocking fluted strip comprising:

a socket means located at one end of the strip for rotatably interconnecting the first interlocking fluted strip with the second interlocking fluted strip such that the first interlocking fluted strip rotates with respect to the second interlocking fluted strip;

an arm cross-section extending at an angle bent away from an opposite end of the strip; and a ball means extending from the arm cross-section for rotatably interconnecting the first interlocking fluted strip with the third interlocking fluted strip such that the first interlocking fluted strip rotates with respect to the third interlocking fluted strip, wherein the rotatable interconnections between the first interlocking fluted strip and each of the second interlocking fluted strip and the third interlocking fluted strip, respectively, facilitate wrapping the flexible wrap of rotatably interlocking fluted strips around an object.

8. The flexible wrap of rotatably interlocking fluted strips of claim 7, wherein the first interlocking fluted strip is configured to have two halves that join in a middle portion of the first interlocking fluted strip to facilitate the wrapping and then locking of the flexible wrap of rotatably interlocking fluted strips around the object.

9. The flexible wrap of rotatably interlocking fluted strips of claim 7, wherein at least a portion of a body of the first interlocking fluted strip includes an exterior having a concave exterior.

10. The flexible wrap of rotatably interlocking fluted strips of claim 7, wherein the socket means for rotatably interconnecting the first interlocking fluted strip with the second interlocking fluted strip comprises a socket cross-sectional area having a circular inner surface of a first diameter configured to accept a ball cross-sectional area having a circular outer surface of a second diameter of the second interlocking fluted strip.

11. The flexible wrap of rotatably interlocking fluted strips of claim 7, wherein the socket means for rotatably interconnecting the first interlocking fluted strip with the second interlocking fluted strip comprises a cross-sectional area having two curved arms forming an inner curved surface that is configured to accept a ball cross-sectional area having a corresponding outer curved surface of the second interlocking fluted strip.

12. The flexible wrap of rotatably interlocking fluted strips of claim 7, wherein the balls means for rotatably interconnecting the first interlocking fluted strip with the third interlocking fluted strip comprises a ball cross-sectional area having a curved outer surface.

13. The flexible wrap of rotatably interlocking fluted strips of claim 7, wherein the ball means for rotatably interconnecting the first interlocking fluted strip with the third interlocking fluted strip comprises a circular ball cross-sectional area.

14. The flexible wrap of rotatably interlocking fluted strips of claim 7, wherein the socket means of the first interlocking fluted strip forms a clearance fit with a second ball means of the second interlocking fluted strip.

15. A flexible wrap of rotatably interlocking fluted strips, the flexible wrap comprising:

a set of rotatably interlocking fluted strips having similarly shaped socket and ball cross-sections, the set including a first fluted strip, a first adjacent fluted strip, and a second adjacent fluted strip, each fluted strip comprising:

a strip having a cross-sectional area with a cross-sectional length;

a socket cross-section located at one end of the cross-sectional length of the cross-sectional area of the strip, the socket cross-section having an inner circular surface of a first diameter;

an arm cross-section located at an opposite end of the strip of the strip, the arm cross-section extending at an angle bent away from the opposite end of the strip; and, a ball cross-section extending from the arm cross-section, the ball cross-section having an outer circular surface of a second diameter, the second diameter of the outer circular surface of the ball cross-section being less than or approximately equal to the first diameter of the inner circular surface of the socket cross-section such that the ball cross-section is configured to rotate within an adjacent socket cross-section of an adjacent fluted strip, wherein (1) the socket cross-section of the first fluted strip is rotatably interlocked with a second ball cross-section of the first adjacent fluted strip, and (2) the ball cross-section of the first fluted strip is rotatably interlocked with a second socket cross-section of the second adjacent fluted strip such that wrapping the flexible wrap of rotatable interlocking fluted strips around an object is facilitated.

16. The flexible wrap of rotatably interlocking fluted strips of claim 15, wherein (a) the socket cross-section of the first fluted strip forms a clearance fit with the second ball cross-section of the first adjacent fluted strip, and (b) the ball cross-section of the first fluted strip forms a clearance fit with the second socket cross-section of the second adjacent fluted strip.

17. The flexible wrap of rotatably interlocking fluted strips of claim 15, wherein the socket cross-section of the first fluted strip is configured to have a gap sized to accept an adjacent arm cross-section of an adjacent fluted strip.

18. The flexible wrap of rotatably interlocking fluted strips of claim 15, wherein the socket cross-section is configured to have two curved arms and an opening between the arms, the opening aligned to be off-set with respect to a longitudinal axis running along a cross-sectional length of a cross-sectional area of the strip to facilitate rotation between adjacent fluted strips.

19. The flexible wrap of rotatably interlocking fluted strips of claim 15, wherein the strip is configured to have two halves that join in a middle portion of the strip to facilitate the wrapping and then locking of the flexible wrap of rotatably interlocking fluted strips around the object.

* * * * *